350-271 SR
7/6/76 XR 3,967,895

United States Patent [19]
Crook

[11] 3,967,895
[45] July 6, 1976

[54] ILLUMINATION CONTROL SYSTEM

[75] Inventor: Douglas L. Crook, Reno, Nev.

[73] Assignee: Xerox Corporation, Stamford, Conn.

[22] Filed: Sept. 18, 1974

[21] Appl. No.: 507,104

[52] U.S. Cl. ..... 355/8; 350/271; 355/60; 355/71
[51] Int. Cl.[2] ..... G03G 15/30
[58] Field of Search ..... 355/8, 11, 67, 71, 55–57, 355/60, 61, 66; 350/271, 272; 353/97

[56] References Cited

UNITED STATES PATENTS

| | | | |
|---|---|---|---|
| 3,076,392 | 2/1963 | Cerasani et al. | 355/11 |
| 3,542,467 | 11/1970 | Ferguson et al. | 355/8 |
| 3,672,759 | 6/1972 | Bauer | 355/3 R |
| 3,865,482 | 2/1975 | Bendall et al. | 355/57 X |

*Primary Examiner*—L. T. Hix
*Assistant Examiner*—Kenneth C. Hutchison
*Attorney, Agent, or Firm*—H. Fleischer; J. J. Ralabate; C. A. Green

[57] ABSTRACT

An apparatus which regulates the duration of time a surface is illuminated. A document is illuminated and the light rays transmitted therefrom are formed into a light image which is projected onto the surface. The duration of time that the light image exposes the surface is regulated in accordance with the position of a device arranged to project the light image onto the surface.

6 Claims, 3 Drawing Figures

ILLUMINATION CONTROL SYSTEM

BACKGROUND OF THE INVENTION

This invention relates generally to electrophotographic printing, and more particularly concerns an improved optical system for projecting a light image onto a moving photoconductive surface having illumination control therefor.

In the process of electrophotographic printing, for example, as disclosed in U.S. Pat. No. 2,297,691, issued to Carlson in 1942, an imaging bearing member or photoconductive member is charged to a substantially uniform potential in order to sensitize its surface. Thereafter, the charged photoconductive surface is exposed to a light image of an original document. As a consequence of the exposure, the charge is selectively dissipated in the irradiated areas in accordance with the light intensity projected onto the charged photoconductive surface recording an electrostatic latent image thereon. Development of the electrostatic latent image recorded on the photoconductive surface is achieved by bringing a developer mix into contact therewith. Typical developer mixes generally comprise dyed or colored thermoplastic particles, known in the art as toner particles, which are mixed with coarser carrier beads, such as ferromagnetic granules. The developer mix is selected such that the toner particles acquire the appropriate charge relative to the electrostatic latent image recorded on the photoconductive surface. The toner powder image is thereupon transferred to a sheet of support material. After the toner powder image has been transferred to the sheet of support material it is permanently affixed thereto.

In order to insure that a copy of the original document is of high quality, a uniformly high level of illumination is required for the system. To this end, the quality of the copy is dependent upon the characteristics of the exposure system. The exposure system is adapted to regulate the intensity of the light image. The intensity of the light image transmitted to the charged photoconductive surface determines the level to which the photoconductive surface is discharged. This, in turn, is instrumental in defining copy contrast. For example, if the exposure system only partially discharges the photoconductive surface, the charge remaining thereon will be higher than normal and the relative difference between the charge on the photoconductive surface and that of the development system will be small. Under these circumstances, a small amount of toner particles will be deposited on the electrostatic latent image resulting in a gray copy. Contrawise, if the intensity of the light image impinging the photoconductive surface is too great, the charge on the photoconductive surface will be dissipated to an appreciably greater level resulting in a toner powder image having high toner powder density. A copy resulting from this powder image will be extremely black and may have high background.

The intensity of illumination may be adjusted by controlling the exposure time. In an electrophotographic printing machine employing a rotating photoconductive drum and an optical system moving in synchronism therewith to scan a stationary original document, the area of the exposure slit determines the exposure time. When the intensity of the light image is low, a more complete discharge of the photoconductive surface is obtained by increasing the exposure time.

Contrawise, if the light image intensity is high, the exposure time may be reduced. Inasmuch as the photoconductive drum and optical system move in synchronism with one another, the light image, relative to the photoconductive surface, is stationary. This permits the exposure slit to control the exposure time or duration within broad limits to compensate for projected light image intensity variations.

Various types of prior art devices have been developed to achieve the foregoing. U.S. Pat. No. 3,049,968 issued to Johanson in 1962, discloses an exposure system employing a manually operable slit aperature. This teaches the use of masks to manually vary the size of an exposure slit. Bauer, U.S. Pat. No. 3,672,759 issued in 1972, describes the use of a motor adapted to vary an exposure slit width in accordance with the intensity of the light transmitted to a photoconductive drum. An additional patent relating thereto is U.S. Pat. No. 3,438,704 issued to Schoen in 1969. This patent teaches the use of a variable width exposure slit. The exposure slit width is adjusted in accordance with a measured light intensity signal. The light intensity signal is derived from a wheatstone bridge arrangement and the width of the slit is varied accordingly.

However, none of the prior art devices appear to provide a simple adjustment for controlling exposure time as a function of the characteristics of the original document being reproduced.

Accordingly, it is an object of the present invention to improve the illumination system by providing a control therefor which is readily adjustable to regulate the duration of time a light image is projected onto a charged photoconductive surface.

SUMMARY OF THE INVENTION

Briefly stated, and in accordance with the present invention, there is provided an apparatus for regulating the duration of time a light receiving member is illuminated.

Pursuant to the features of the present invention, a source of illumination is arranged to generate light rays. These light rays illuminate an original document positioned on a support member in a light receiving relationship therewith. Optical means are disposed to receive the light rays transmitted from the original document on the support member. The optical means create a light image of the original document which is projected onto the light receiving surface. Light masking means, operatively associated with the optical means, regulate the duration of time the light image is transmitted to the light receiving surface. The light masking means adjust the time the light image illuminates the light receiving surface in accordance position of the portion of the optical means arranged to project the light image onto the light receiving surface.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
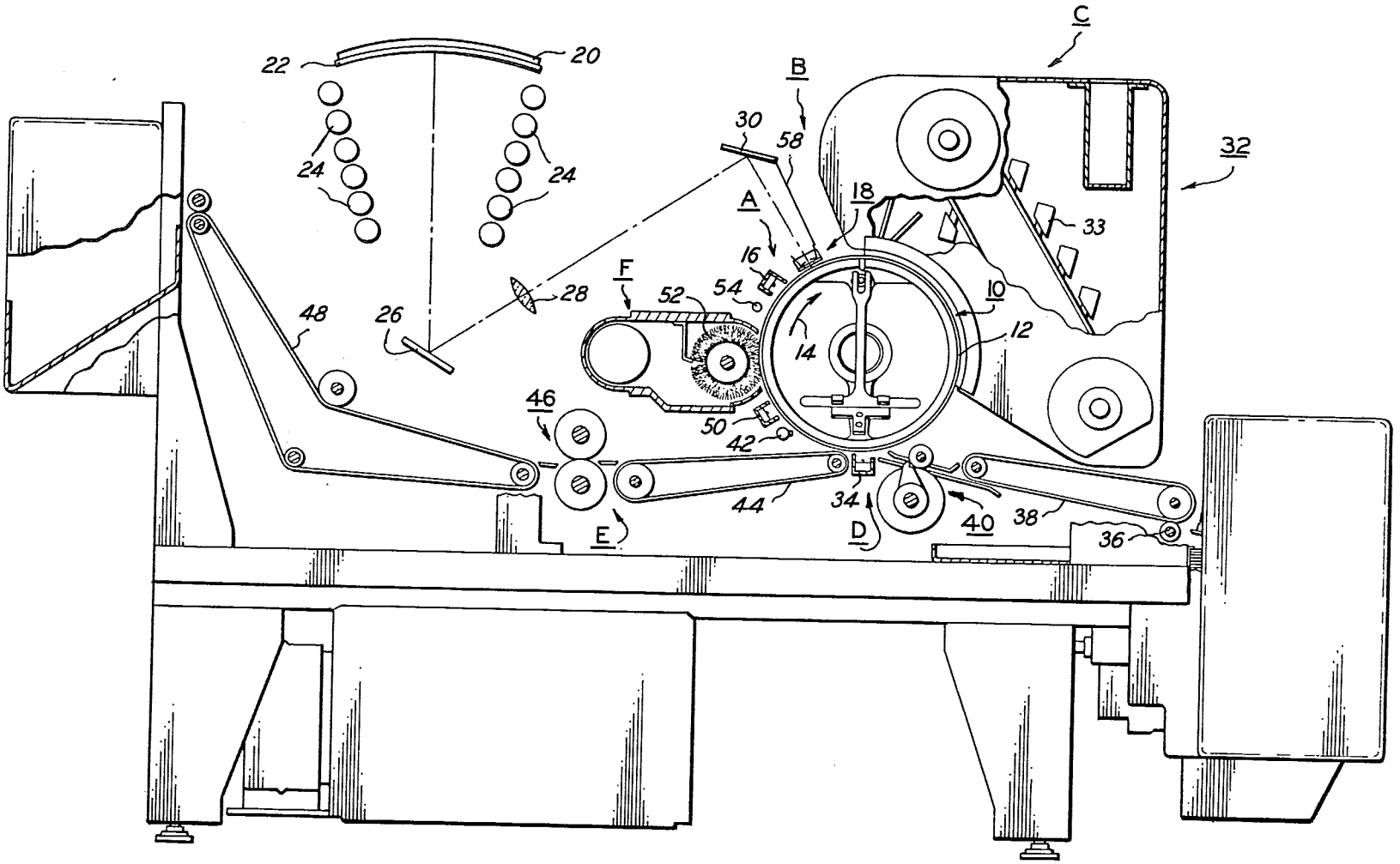
FIG. 1 schematically depicts a preferred embodiment of an electrophotographic printing machine having an optical system with illumination control therein.

For a general understanding of an electrophotographic printing machine in which the present invention may be incorporated, reference is had to FIG. 1 which depicts schematically the various system components thereof. Throughout this description, like reference numerals will be employed to designate like elements. Although the apparatus for controlling the illumination of the exposure system is particularly well adapted for use in electrophotographic printing, it should become evident from the following discussion that it is equally well suited for use in a wide variety of devices and is not necessarily limited in its application to the particular embodiment shown herein.

As in all electrophotographic systems of the type illustrated, an image bearing member comprising a drum 10 with photoconductive surface 12 entrained about an secured to the exterior circumferential surface thereof is rotated, in the direction of arrow 14, through a series of processing stations.

Initially, photoconductive surface 12 passes through charging station A which is adapted to sensitize the surface thereof. Charging station A includes a corona generating device, indicated generally at 16, positioned closely adjacent to photoconductive surface 12. Corona generating device 16 charges photoconductive surface 12 to a relatively high substantially uniform potential. One type of suitable corona generating device is described in U.S. Pat. No. 2,836,725 issued to Vyverberg in 1958.

The charged photoconductive surface is next rotated to exposure station B. Pursuant to the features of the present invention, illumination control is achieved by light masking means or slit mechanism 18 which is selectively opened and closed. Slit mechanism 18 is positioned in the path of a flowing light image projected from a stationary original document 20 onto photoconductive surface 12. Exposure station B includes an optical scanning or projection system including a stationary copy board which comprises a transparent curved platen member 22 such as a glass plate or the like, adapted to support original document 20. A bank of lamps 24 illuminate original document 20. The scanning of original document 20 is achieved by oscillating mirror 26 in a timed relationship with the movement of drum 10. Mirror 26 positioned beneath support 22 and adapted to reflect a light image of the original document through a spherical lens 28 onto mirror 30 which, in turn, transmits the light image through slit mechanism 18 onto charged photoconductive surface 12. Mirror 30 is movable, the movement thereof being employed to adjust the width of the slit in slit mechanism 18 so as to regulate the duration of time the light image illuminates photoconductive surface 12. The general optical system and slit mechanism 18 will be described hereinafter in greater detail with reference to FIGS. 2 and 3.

After exposure, drum 10 rotates the electrostatic latent image recorded on photoconductive surface 12 to development station C. Development station C includes a development apparatus 32 comprising a housing having a lower sump for accumulating a developer mix of carrier granules and toner particles. Bucket conveyor 33 is employed to move the developer mix from the lower sump to the upper region thereof where it is cascaded in a downwardly direction over the electrostatic latent image recorded on photoconductive surface 12. In this manner, the toner particles are electrostatically attracted to the electrostatic latent image and form a toner powder image on photoconductive surface 12.

As shown in FIG. 1, a sheet of support material is advanced by the sheet feeding apparatus to transfer station D. At transfer station D a corona generating device 34 is arranged to spray ions onto the back side of the sheet of support material, which may be a sheet of plain paper or a thermoplastic sheet, so as to attract the toner powder image from photoconductive surface 12 thereto.

Prior to proceeding with the description of the various processing stations about the periphery of drum 10, the sheet feeding apparatus will be briefly described.

The sheet feeding apparatus includes a sheet feed device employing vacuum feeders to advance the uppermost sheet of a stack of sheets to roller 36. Roller 36 cooperates with the belts of paper transport 38 for advancing the sheet of support material. Transport 38 moves the sheet of support material to a sheet registration device 40. Sheet registration device 40 is located adjacent to drum 10. Registration device 40 arrests and aligns each successive advancing sheet of support material and then, in a timed relationship to the movement of drum 10, advances the sheet of support material into contact with photoconductive surface 12 in registration with the toner powder image adhering thereto. Thereafter, corona generator 34 transfers the toner powder image from photoconductive surface 12 to the sheet of support material. Corona generator 34 is positioned at or immediately after the point of contact between the sheet of support material and photoconductive surface 12. In operation, the sheet of support material moves synchronously with photoconductive surface 12 while in contact therewith. Substantially simultaneously therewith, corona generator 34 produces an electrostatic field effective to attract the toner particles from photoconductive surface 12 to the sheet of support material forming a toner powder image thereon.

After transfer of the toner powder image to the sheet of support material, stripping apparatus 42 removes the sheet of support material from photoconductive surface 12. Stripping apparatus 42 develops a flow of periodically pulsated pressurized air which separates the sheet of support material from photoconductive surface 12. After the sheet of support material is separated from photoconductive surface 12, endless belt conveyor 44 advances it to fusing station E.

At fusing station E, a suitable fusing apparatus 46 generates sufficient heat to permanently affix the toner powder image to the sheet of support material. After the toner powder image is permanently affixed to the sheet of support material conveyor 48 advances it to a catch tray enabling the machine operator to readily remove it.

Continuing now with the various processing stations positioned about the periphery of drum 10. Invariably, after the sheet of support material is stripped from photoconductive surface 12 some residual toner particles adhere thereto. These residual toner particles are removed from photoconductive 12 at cleaning station F. Initially, the toner particles are brought under the influence of a corona generating device 50 adapted to neutralize the remaining electrostatic charge on photoconductive surface 12 and the residual toner particles. The neutralized toner particles are cleaned from photoconductive surface 12 by a rotatably mounted fibrous brush in contact therewith. Subsequently thereto, discharge lamp 54 floods photoconductive surface 12 with light to dissipate any residual electrostatic charge remaining thereon prior to the charging thereof for the next successive cycle.

It is believed that the foregoing description is sufficient for purposes of the present application to depict the general operation of an electrophotographic printing machine incorporating the teachings of the present invention therein. For further details concerning the specific construction of the printing machine, reference is made to U.S. Pat. No. 3,438,704 issued to Schoen in 1969, the relevant portions thereof being hereby incorporated into the present application.

Figure 2:
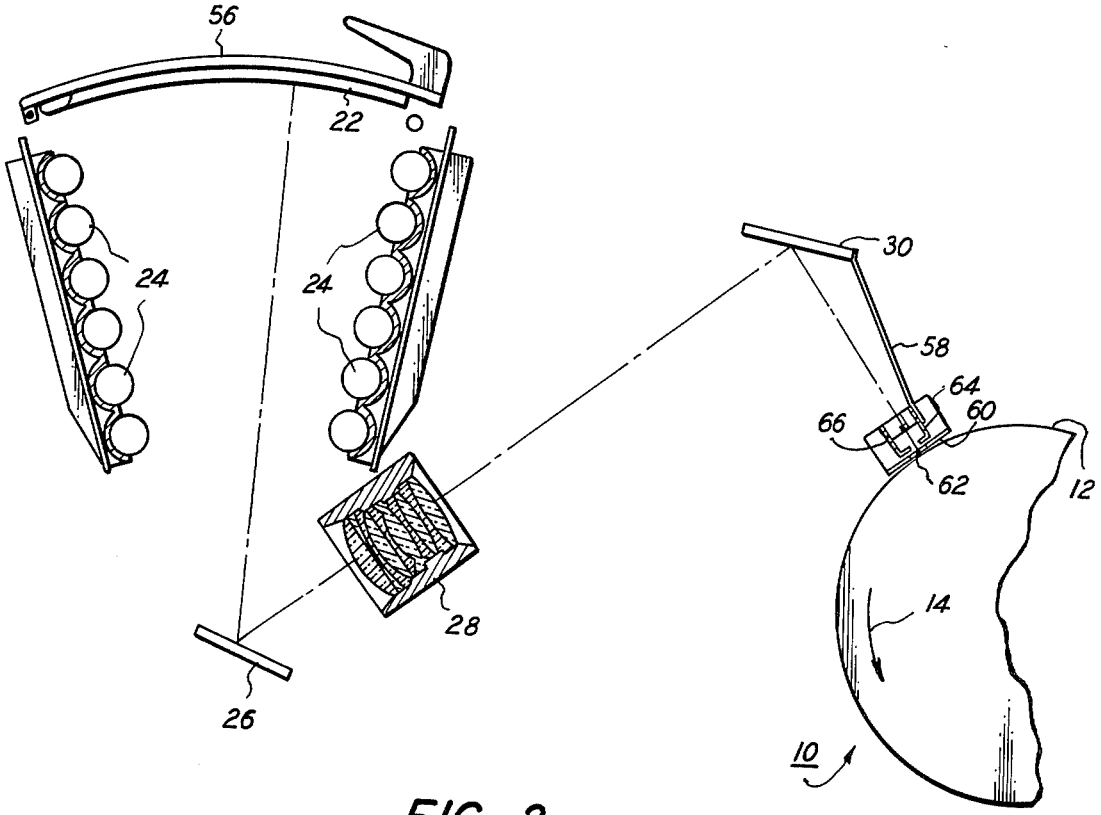
FIG. 2 is an elevational view of the FIG. 1 printing machine optical system.
Figure 3:
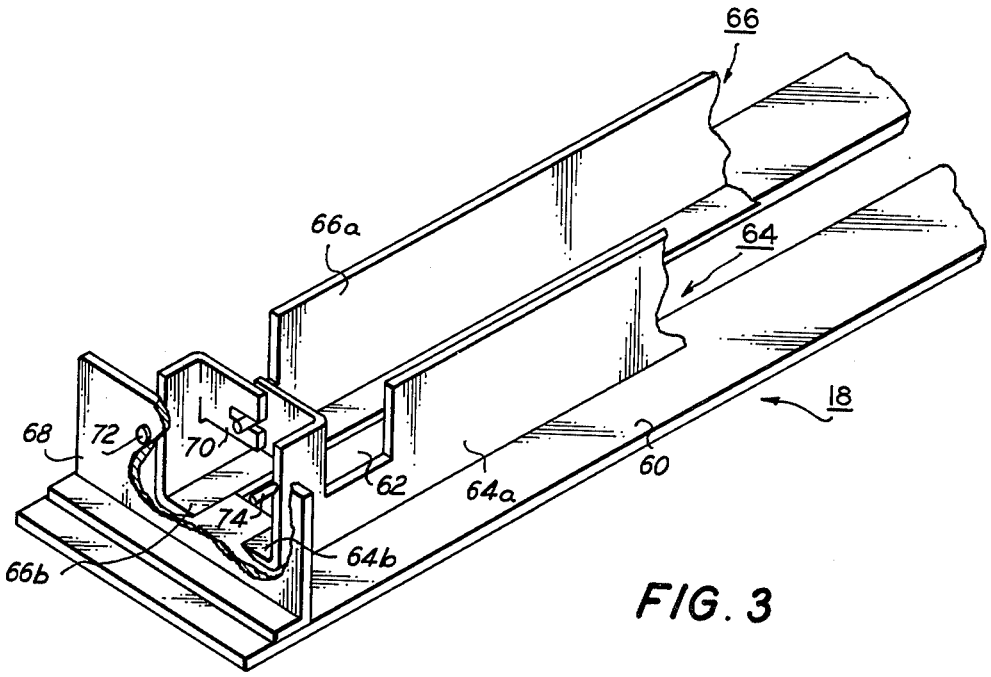
FIG. 3 is a perspective view of the variable width slit aperature mechanism employed in the FIG. 2 optical system.

Referring now to FIGS. 2 and 3, the specific subject matter of the present invention will be described in greater detail. FIG. 2 illustrates the overall optical system while FIG. 3 depicts the slit mechanism adapted to regulate the duration of time the light image illuminates the charged photoconductive surface.

Turning now to FIG. 2, cover 56, which is opaque, is positioned movably over platen 22 with the original document interposed therebetween. Lamps 24 are arranged to illuminate the original document disposed upon transparent platen 22. Mirror 26 is oscillated so that the entire area of the original document is scanned. The oscillation of mirror 26 is controlled to be in synchronism with the rotation of drum 10. Mirror 26 is driven by a scan cam (not shown) which is located inside a drive system. The scan cam is attached to the shaft of drum 10 and makes one revolution for each revolution of drum 10. Motion of the scan cam is transmitted through a drive mechanism to the scan mirror. The drive mechanism includes a cam follower positioned on the scan cam, a drive cam, a scan tape and a driven cam secured to the scan mirror. The scan cam has three lobes and causes mirror 26 to scan the document three times for each revolution of drum 10. The cam is shaped so that the scan return takes about 1/10th as much time as the scan. The scan follower tracks the contour of the scan cam and transmits the resulting motion to the mirror drive cam. The scan tape is attached to the mirror drive cam and the mirror driven cam which is coupled to the scan mirror. A driven cam spring provides the force necessary to keep the scan tape tensioned and the cam follower against the scan cam. The motion of the scan cam follower causes the mirror driven cam and the scan mirror to pivot back and forth. The driven cam spring applies additional tension to the scan tape and reduces the pressure of the scan cam follower against the scan cam resulting in less wear. The light rays transmitted from the original document are reflected from mirror 26 through lens 28. Lens 28 has a fixed aperature of F4.5. The light rays passing through lens 28 are thereby formed into a light image of the original document. This resultant light image is transmitted to mirror 30. Mirror 30 is substantially stationary in that it does not rotate about an axis thereof. However, mirror 30 is adapted to be moved laterally. The movement of mirror 30 adjusts the width of the aperture in slit mechanism 18. Mirror 30 is coupled to slit mechanism 18 via bar 58. Slit mechanism 18 includes a base plate 60 having an elongated longitudinally extending slit 62 therein. A pair of opposed spaced L-shaped side walls 64 and 66 are disposed movably on base plate 60. Movement of mirror 30 moves bar 58 which in turn side walls 64 and 66. Movement of side walls 64 and 66 regulates the width of aperture 62. It should be noted that the optical center line remains substantially constant and that only the width of the slit is regulated. The detailed structural configuration of slit mechanism 18 will be described hereinafter in greater detail with reference to FIG. 3. Thus, as drum 10 rotates photoconductive surface 12 in the direction of arrow 14 successive incremental widths of the light image are transmitted thereto. The duration of time that the light image exposes photoconductive surface 12 is regulated by varying the width of slit 62. This is achieved, once again, by moving side walls 64 and 66 through the movement of mirror 30 in conjunction with bar 58. A narrow exposure slit is employed to reduce the time that the image irradiates photoconductive surface 12. The width of the exposure slit is increased by moving mirror 30 to increase the time that the light image irradiates photoconductive surface 12. This is required in order to compensate for low intensity light images. In this way, the time that the light image irradiates photoconductive surface 12 may be optimized for the respective original document being reproduced. Thus, an original document composed merely of lines would require one exposure time whereas one composed primarily of background would require a different exposure time.

Turning now to FIG. 3, there is shown the light masking means or a slit mechanism 18. As hereinbefore indicated, slit mechanism 18 includes a base plate 60 having an elongated slit 62 therein. Base plate 60 is impervious to light and is made from an opaque material, i.e., black painted sheet metal. End walls 64 and 66 are L-shaped having uprights **64*a* and 66*a* respectively, mounted pivotably on side walls 68 and extending in an upward direction from base plate 60. Bottom walls 64*b* and 66*b* extend substantially parallel to base plate 60 overlapping slit 62. Thus, as end walls 64 and 66 pivot the aperture defined by bottom walls 64*b* and 66*b* varies. By way of example, this aperture may vary from approximately 0.250 inches to 0.100 inches. Stops are provided to limit the maximum and minimum apertures. In the preferred embodiment thereof wall 64 is coupled to wall 66 through connector 70. Connector 70 insures that the movement of bar 58 connected to wall 64 is transmitted to wall 66. In this manner, both walls 64 and wall 66 pivot equal amounts about pins 72 and 74 securing the respective walls to side walls 68**. This insures that the optical center line remains substantially constant with the aperture being varied about the optical center line.

In electrophotographic printing machines which reduce the size of the copy as compared with the original document, the intensity of the light image increases as the copy size is reduced. Thus, it is necessary to decrease the exposure time. As the copy size decreases from being the same as the original document to 61% of the original document, the width of the exposure slit will decrease from about 0.250 inches to about 0.125 inches. In the reduction mode of operation, the mirror is moved automatically in response to the selection of the desired copy size reduction so as to adjust the exposure slit accordingly.

In recapitulation, the illumination control system adjusts the slit mechanism so as to regulate the duration of time the light image illuminates the photoconductive surface. This is achieved by a laterally movable mirror coupled to a variable width slit mechanism. Movement of the mirror adjusts the slit width controlling the duration of time the light image illuminates the charged photoconductive surface.

It is, therefore, evident that there has been provided, in accordance with the present invention, an apparatus for controlling the duration of time a light image illuminates a photoconductive surface. This apparatus substantially optimizes the copy being reproduced in the electrophotographic printing machine and satisfies the objects, aims and advantages set forth above. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for controlling exposure of a light receiving surface, including:

a source of illumination for generating light rays;

a support member for positioning a document in a light receiving relationship with the light rays generated by said illumination source;

optical means disposed to receive the light rays transmitted from the document on said support member for creating a light image thereof;

light masking means interposed in the path of the light image, said light masking means comprising a base plate having an elongated light transmitting first slit therein, and a pair of substantially opaque, spaced apart movable wall members defining a second slit in juxtaposition with the first slit; and a movable mirror interposed between said optical means and said light masking means for directing the light image through the first and second slits in said light masking means, said mirror being coupled to the pair of spaced apart walls of said light masking means and being arranged to move in unison therewith so that movement of said mirror regulates the width of the second slit in said light masking means, thereby defining the size of the second slit through which the light image passes.

2. An apparatus as recited in claim 1, wherein each of said pair of wall members move sustantially equal distances about the optical center line in a direction substantially transverse thereto in response to the movement of said mirror.

3. An apparatus as recited in claim 2, wherein said optical means includes:

a lens; and an oscillatable mirror to scan different portions of the document and arranged to transmit the light rays from the document to said lens.

4. An electrophotographic printing machine for reproducing an original document, including:

a photoconductive member;

means for charging said photoconductive member to a substantially uniform potential;

a source of illumination for generating light rays;

a support member for positioning the original document in a light receiving relationship with the light rays generated by said illumination source;

optical means disposed to receive the light rays transmitted from the document on said support member for creating a light image thereof;

light masking means interposed in the light image, said light masking means comprising a base plate having an elongated light transmitting first slit therein, and a pair of substantially opaque spaced apart movable wall members defining a second slit in juxtaposition with the first slit; and a movable mirror interposed between said optical means and said light masking means for directing the light image through the first and second slits in said light masking means onto the charged portion of said photoconductive member, said mirror being coupled to the pair of spaced apart walls of said light masking means and being arranged to move in unison therewith so that movement of said mirror regulates the width of the second slit in said light masking means, thereby defining the size of the second slit through which the light image passes.

5. A printing machine as recited in claim 4, wherein each of said pair of wall members move substantially equal distances about the optical center line in a direction substantially transverse thereto in response to the movement of said mirror.

6. A printing machine as recited in claim 5, wherein said optical means includes:

a lens; and an oscillatable mirror to scan differing portions of the document and arranged to transmit the light rays from the document to said lens.

* * * * *